US006398843B1

(12) United States Patent
Tarrant

(10) Patent No.: US 6,398,843 B1
(45) Date of Patent: Jun. 4, 2002

(54) DISPERSION-STRENGTHENED ALUMINIUM ALLOY

(75) Inventor: Andrew Tarrant, Farnborough (GB)

(73) Assignee: Qinetiq Limited, London (GB)

( * ) Notice: Subject to any disclaimer, the term of this patent is extended or adjusted under 35 U.S.C. 154(b) by 0 days.

(21) Appl. No.: 09/445,570

(22) PCT Filed: Jun. 3, 1998

(86) PCT No.: PCT/GB98/01620

§ 371 (c)(1),
(2), (4) Date: May 4, 2000

(87) PCT Pub. No.: WO98/56961

PCT Pub. Date: Dec. 17, 1998

(30) Foreign Application Priority Data

Jun. 10, 1997 (GB) ..... 9711876

(51) Int. Cl.[7] ..... C22C 21/00

(52) U.S. Cl. ..... 75/249; 75/230; 75/235; 75/236; 75/244; 75/232; 419/10; 419/13; 419/14; 419/19; 419/32

(58) Field of Search ..... 75/249, 235, 236, 75/230, 232, 244; 419/10, 13, 14, 19, 32

(56) References Cited

U.S. PATENT DOCUMENTS 3,816,080 A * 6/1974 Bomford et al.
3,877,884 A * 4/1975 Tawarada et al.
4,623,388 A * 11/1986 Jatkar et al. ..... 75/232
4,643,780 A * 2/1987 Gilman et al.
5,589,652 A * 12/1996 Arato et al. ..... 75/235
5,632,827 A 5/1997 Fujita ..... 148/688

FOREIGN PATENT DOCUMENTS

| | | |
|---|---|---|
| EP | 0751228 | 1/1997 |
| JP | 8-260075 | 10/1996 |

OTHER PUBLICATIONS

Patent Abstracts of Japan, vol. 097, No. 002, Feb. 28, 1997 & JP 08260075 A (YKK KK), Oct. 8, 1996 see abstract.

* cited by examiner

*Primary Examiner*—Ngoclan Mai
(74) *Attorney, Agent, or Firm*—Nixon & Vanderhye

(57) ABSTRACT

A dispersion-strengthened material is described which comprises aluminium or aluminium alloy containing a substantially uniform dispersion of ceramic particles to confer dispersion strengthening which is inherently stable at high working temperatures, the ceramic particles having a diameter of less than 400 nm, and preferably in the range 10 nm to 100 nm. Suitable ceramic dispersoids include $Al_2O_3$, $TiO_2$, $Al_3C_4$, $ZrO_2$, $Si_3N_4$, SiC, $SiO_2$.

13 Claims, No Drawings

DISPERSION-STRENGTHENED ALUMINIUM ALLOY

The invention relates to a dispersion-strengthened aluminium alloy exhibiting improved stability of strengthening at elevated temperature, and to a method of manufacture thereof.

Aluminium alloys are widely used as structural materials in weight critical applications, such as for aircraft construction. Strength is commonly achieved by alloying additions such as copper, magnesium, lithium or zinc to produce a dispersion of fine precipitates following suitable heat treatment. These conventional aluminium alloys have limited capability for use at elevated temperatures; or long term creep application they are generally not used at greater than 150° C. for shorter term applications 200 to 300° C. might be a more realistic limit to the working temperature range. The alloys arc limited in use by the limited strengthening exhibited at elevated temperature resulting from the tendency for precipitates to coarsen significantly as the temperature is raised. This reduces their effectiveness as strengthening phases at elevated temperature, and also their effectiveness as strengthening phases at room temperature after an elevated temperature treatment.

Significant developments have been made using rapid solidification techniques to introduce alloy elements that do not coarsen significantly at temperatures in excess of 200° C. Examples of alloying elements most commonly used are Fe, V, Si . Ce etc. These approaches produce aluminium alloys with good strength at temperatures of up to 400° C. However, they are difficult to fabricate because at temperatures exceeding 400° C., the strengthening precipitates coarsen significantly and hence reduce their strengthening effectiveness. This means that the temperatures for forming components manufactured from such materials must be limited to less than 400° C. Such constraints can impose significant limitations on the range of engineering components which can be effectively manufactured from these materials. Japanese patent publication number 082670075 and U.S. Pat. No. 5,632,827 both describe an aluminium material having ceramic dispersoids, which in both cases are formed by in situ development by precipitation during mechanical alloying and die formation respectively. EP 0751 228 relates to a titanium aluminium intermetallic having ceramic dispersoids also formed in situ. However, the size and dispersion of ceramic particles formed in this manner is difficult to control.

The present invention is directed towards the provision of an aluminium alloy based on principles of dispersion strengthening which mitigates some or all of the above problems and in particular which exhibits enhanced dispersoid stability at elevated temperature.

According to a first aspect of the invention, a dispersion-strengthened material comprises aluminium or aluminium alloy containing a substantially uniform dispersion of ceramic particles, characterised in that the ceramic particles have a diameter of less than 400 mm.

The present invention takes a radically different approach from any prior art technique based on conventional and rapid solidification routes which rely on precipitate dispersions whose thermal stability is thus inherently limited by coarsening since it provides an aluminium alloy dispersion strengthened with particles which are inherently stable at these working temperatures. The strengthening effect produced thus shows greater stability over time at elevated temperatures than will be possible in any system based on precipitate dispersions. Particle size is preferably less than 100 nm and optimally in the range 10–30 nm. Particles which are finer than this become difficult to distribute evenly; particles which are coarser begin to become less effective as strengthening dispersoids.

Techniques are known to enhance the elastic modulus of aluminium alloys by addition of a dispersion of ceramic particles, but in this field it is found that to achieve elastic modulus modifications particle sizes typically need to be in the range 3000 to 30,000 nm. The current invention is directed to the very different materials problem of dispersion strengthening and produces a material which exhibits enhanced dispersoid stability at elevated temperature. The particle sizes required to solve this problem, at typically less than 400 nm and preferably less than 100 nm, are thus significantly finer than those used to modify elastic modulus, and particles of the size used for the latter purpose would be too large to provide any substantial dispersion strengthening effect.

To maximise stability the dispersoids are preferably metal oxides, carbides or nitrides. Without limiting the scope of the invention, examples of dispersoid phases are; $A_2O_3$, $TiO_2$, $Al_3C_4$, $ZrO_2$, $Si_3N_4$, SiC, $SiO_2$. The stability of these phases a fabrication, typically by forging, rolling or extrusion processes at high temperature, often greater than 500° C., without significant coarsening of the dispersed particles. The dispersion may be controlled to include more than one type of ceramic dispersoid particle. Dispersoid particle volume fractions can range from 1 to 25 volume per cent, but more preferably in the range 5 to 15 volume percent.

The dispersion may be controlled to include more than one size of ceramic dispersoid particle within the specified size range; that is to say to include a first set of ceramic dispersoid particles of substantially similar diameter, and at least one further set ceramic dispersoid particles of substantially similar diameter but of substantially different diameter to the first set. The resultant bimodal or multimodal size distribution enables optimistation of interparticle spacing for a given volume fraction of dispersoid.

A surprising result is found when $TiO_2$ is used as the dispersoid phase. An alloy containing $TiO_2$ produces better ductility at room temperature and especially at elevated temperature than when other types of dispersoid are used. Another advantage is that the aluminium or aluminium alloys containing this particular dispersoid can be aged by heating to above 500° C. and more preferably to 550° C. It is thought that the $TiO_2$ reacts to form titanium aluminides when the alloy is heated above 500° C.

It will be readily understood that choice of aluminium alloys is not limited in this invention, but will instead be determined by the balance of strength and ductility required by given materials applications. In general, materials in accordance with the invention can be expected to be more dilute than conventional systems because the dispersoid, to a great extent, replaces the need for alloy additions to form conventional precipitates. Alloy composition may include, but are not limited to: pure aluminium, solid solution alloys containing magnesium and/or lithium, and conventional alloys containing copper, zinc, manganese, lithium. Alloys of aluminium with lithium and magnesium are especially appropriate, preferably comprising 0.1 to 1.7 weight percent lithium and 0.1 to 4.0 weight percent magnesium, more preferably 0.1 to 0.75 weight percent lithium and 0.1 to 2.0 weight percent magnesium, most preferably 0.1 to 0.4 weight percent lithium and 0.1 to 1.5 weight percent magnesium.

Substantial improvements to strength at elevated temperature of 300 to 500° C. are achieved with this invention.

Such improvements are combined with outstanding fatigue performance at elevated temperature and good resistance to creep. More than 95% strength is retained at room temperature after soaking at temperatures close to the alloy solidus.

To ensure that dispersoid is present in sufficient quantity to produce a significant strengthening effect, the dispersoids are conveniently added as a separate phase to the matrix using a powder metallurgical route. Thus in a further aspect the invention comprises a method of manufacture of a dispersion-strengthened material comprising the mixing of powdered aluminium or aluminium alloy with ceramic particles having a diameter of less than 400 nm, the blending of the resultant mixture to produce a substantially uniform dispersion of ceramic particles, and the consolidation of the resultant blend to produce a solid material. A mechanical alloying step is preferably included in the process to achieve improved uniformity of ceramic particle dispersion.

Typical compositions of materials in accordance with the invention, and properties thereof, will now be given by way of example only.

A variety of aluminium alloys were blended and mechanically alloyed with alumina or titanium dioxide particles. Powders were compacted and extruded to form 14 mm diameter bar. Tensile test results in an as extruded condition are detailed in Table 1 for room temperature and elevated temperature.

TABLE 1

Tensile Test Results in the As-Extruded Condition

| Aluminium Alloy Matrix | Dispersoid Volume %, Type and average particle size | 0.2% Yield Strength (MPa) at 24° C. | 0.2% Yield Strength (MPa) at 300° C. | 0.2% Yield Strength (MPa) at 350° C. |
|---|---|---|---|---|
| Commercial Purity | 10% $Al_20_3$ 13 nm | 395 | 216 | 179 |
| Commercial Purity | 10% $Ti0_2$ 23 nm | 342 | 223 | 186 |
| Aluminium 0.3 Li 1 Mg Alloy | None | 168 | 56 | 46 |
| Aluminium 0.3 Li 1 Mg Alloy | 10% $Al_20_3$ 13 nm | 424 | 174 | 156 |
| Aluminium 0.3 Li 1 Mg Alloy | 10% $Ti0_2$ 23 nm | 332 | 179 | 188 |
| Aluminium 0.3 Li 1 Mg Alloy | 7.5% $Ti0_2$ 23 nm | 296 | 184<br>176 | 150<br>159 |
| Aluminium 0.3 Li 1 Mg Alloy | 12.5% $Ti0_2$ 23 nm | 359<br>381 | 212<br>211 | 201<br>189<br>185 |
| Aluminium 0.75 Li 2 Mg Alloy | 5% $Ti0_2$ 23 nm | 327 | 174 | 146 |
| Aluminium 0.75 Li 2 Mg Alloy | 15% $Al_20_3$ 13 nm | 579 | 221 | |

What is claimed is:

1. A method of manufacture of a dispersion-strengthened material comprising the steps of:

(a) mixing the powdered or aluminum alloy matrix with ceramic particles added as a separate phase to the matrix and having a diameter of less than 30 nm wherein the ceramic particle content is in the range 1 to 25 volume percent;

(b) blending of the resultant mixture to produce an essentially uniform dispersion of ceramic particles; and (c) consolidating the resultant blend to produce a solid material.

2. A method of manufacture in accordance with claim 1 further comprising the step of:

mechanically alloying the powder mixture to produce an essentially uniform dispersion of ceramic particles.

3. A method of manufacture in accordance with claim 1 wherein the ceramic particles have a diameter in the range 10 nm to 30 nm.

4. A method of manufacture in accordance with claim 1 wherein the ceramic particle content is in the range 5 to 15 volume percent.

5. A method of manufacture in accordance with claim 1 wherein the ceramic particles are selected from a group consisting of $Al_2O_3$, $TiO_2$, $Al_3C_4$, $ZrO_2$, $Si_3N_4$, SiC, and $SiO_2$.

6. A method of manufacture in accordance with claim 1 wherein the dispersion controlled to include more than one ceramic particles.

7. A method of manufacture in accordance with claim 1 wherein the dispersion is controlled to include a first set of ceramic dispersoid particles of similar diameter, and at least one further set ceramic dispersoid particles of similar diameter but of different diameter to the first set.

8. A method of manufacture in accordance with claim 5 wherein the ceramic particles are $TiO_2$.

9. A method of manufacture in accordance with claim 8 wherein the solid material is age hardened by heating the material to above 500° C.

10. A method of manufacture in accordance with claim 1 wherein the solid material is an aluminum alloy containing lithium and magnesium.

11. A method of manufacture in accordance with claim 10 wherein the solid material comprises 0.1 to 1.7 weight percent lithium and 0.1 to 4.0 weight percent magnesium.

12. A method of manufacture in accordance with claim 11 wherein the solid material comprises 0.1 to 0.75 weight percent lithium and 0.1 to 2.0 weight percent magnesium.

13. A method of manufacture in accordance with claim 12 wherein the solid material comprises 0.1 to 0.4 weight percent lithium and 0.1 to 1.5 weight percent magnesium.

* * * * *